US005429267A

United States Patent [19]

San

[11] Patent Number: 5,429,267

[45] Date of Patent: Jul. 4, 1995

[54] SUB-CYLINDER FOR LIQUIFIED PETROLEUM GAS

[76] Inventor: Toh K. San, Block 183 Boon Lay Drive #01-544, Singapore 2264, Singapore

[21] Appl. No.: 146,889

[22] Filed: Nov. 3, 1993

[51] Int. Cl.[6] ..... F17C 1/00

[52] U.S. Cl. ..... 220/581; 220/582; 220/501; 220/506

[58] Field of Search ..... 220/581, 582, 501, 506

[56] References Cited

U.S. PATENT DOCUMENTS

| | | | |
|---|---|---|---|
| 567,764 | 9/1896 | Dixon | 220/581 X |
| 2,019,004 | 10/1935 | Endacott | 220/581 |
| 2,467,428 | 4/1949 | Hansen et al. | 220/581 |
| 4,606,384 | 8/1986 | Neukomm . | |
| 5,190,184 | 3/1993 | Lechner | 220/581 |

FOREIGN PATENT DOCUMENTS

| | | | |
|---|---|---|---|
| 0817494 | 9/1937 | France | 220/581 |
| 0348888 | 8/1937 | Italy | 220/581 |
| 0491263 | 11/1955 | Italy | 220/581 |
| 0525109 | 7/1957 | Italy | 220/581 |
| 0196638 | 6/1938 | Switzerland | 220/581 |
| 244590 | 12/1925 | United Kingdom . | |
| 883677 | 12/1961 | United Kingdom . | |

*Primary Examiner*—Allan N. Shoap
*Assistant Examiner*—Stephen Cronin
*Attorney, Agent, or Firm*—Edward J. Chalfie

[57] ABSTRACT

A liquified petroleum cylinder has a reserve cylinder within it provided with a separate outlet external to the main cylinder. The reserve cylinder may be provided with a non-return valve (not shown in FIG. 1), whereby both cylinders may be filled with gas through the same external valve.

3 Claims, 3 Drawing Sheets

SUB-CYLINDER FOR LIQUIFIED PETROLEUM GAS

This invention relates to cylinders for holding liquified petroleum gas (LPG).

In areas where there is no public piped gas supply, gas used for domestic purposes, which, in practice means primarily for cooking, is supplied in cylinders containing liquified petroleum gas. The cylinders are of such a size and weight as to be relatively easily transportable from a vehicle to the consumer's installation, and a standard size containing 12.7 killogrammes of liquified gas is commonly used. The cylinders are refillable, being provided with a closure valve which acts as a non-return valve when unconnected to any external equipment but is opened on tightening the-union connecting it to the system at the consumer's premises.

So long as there is liquid within the cylinder the pressure of the gas is equal to the vapour pressure of the liquid and so gives no indication of the amount of liquid remaining within the cylinder, this being determinable only by accurate weighing. When nearly all the gas has been used, so that no more liquid remains, the pressure of the remaining gas drops fairly rapidly as it is used. The consumer, therefore, has very little warning of when the cylinder is exhausted, at which point it must be exchanged for a refilled cylinder.

Apart from the space occupied by a spare cylinder, fully charged LPG cylinders represent something of a fire and explosion hazard, and in many cases the amount of such inflammable material that is permitted to be stored on domestic premises is strictly limited by law. It is, therefore, undesirable and, in many cases, impracticable or illegal, for the consumer always to have a spare full cylinder available for interchange as soon as the cylinder currently in use runs out. The consumer must therefore arrange to purchase a replacement cylinder and have it delivered in order to continue making use of a gas supply. This, of course, has unfortunate results if a cylinder becomes exhausted in the middle of, for example, the cooking of a meal.

It is an object of the present invention, which is defined in the appended claims, to provide a means of obviating this difficulty. This object is attained by providing a reserve supply of LPG in a reserve cylinder contained within the main gas cylinder.

Attention may be drawn to Patent Specification GB 244590, which also provides a system in which an outer gas cylinder has a further gas cylinder within it, but in that case the inner cylinder is a high-pressure cylinder and is provided-with a pressure-reducing valve, the system enabling the outer cylinder to be of lighter construction than would otherwise be the case.

The invention will be further described with reference to the accompanying drawings in which.

Figure 1:
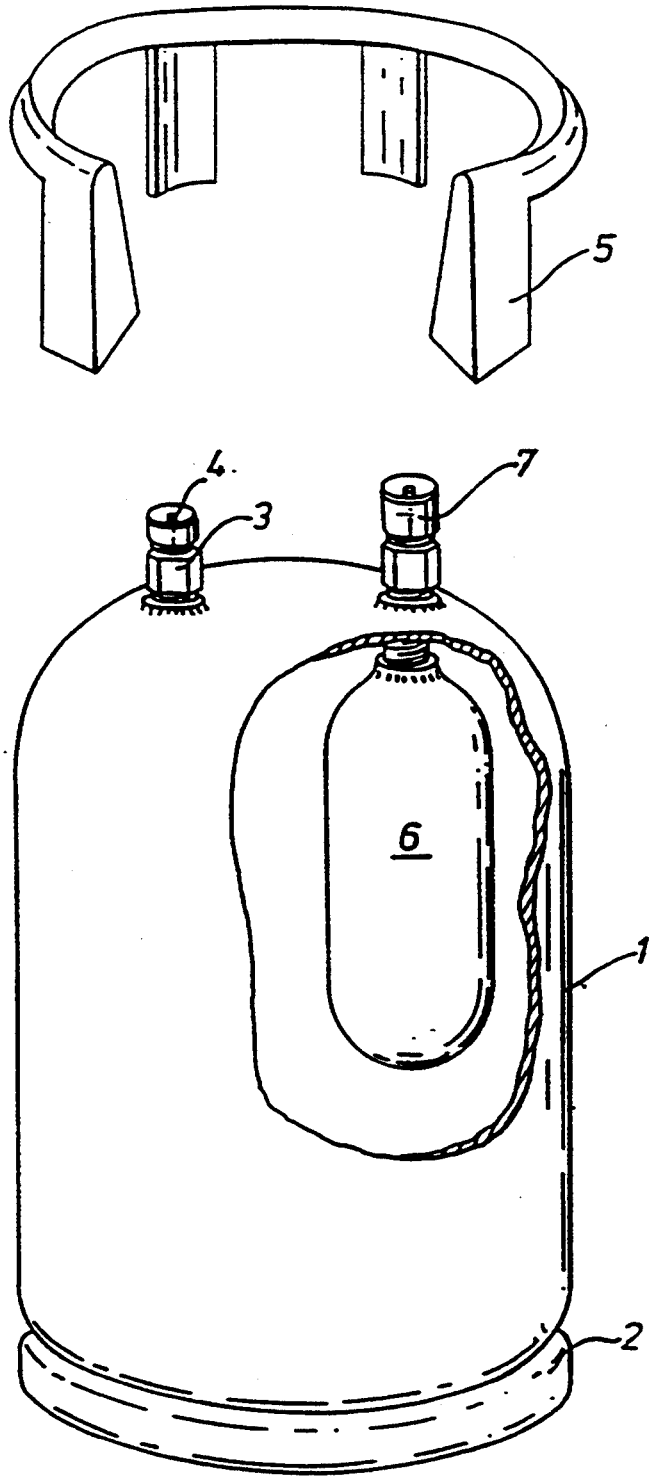
FIG. 1 is a partially broken-away view of an LPG cylinder according to one embodiment of the present invention.

Referring first to FIG. 1, an LPG cylinder 1 is of welded construction and is provided with a base 2 to enable it to stand upright in use, and with a valve 3 through which it is filled and by means of which it is connected to the gas system at the consumer's premises. The valve 3 functions as a non-return valve during filling and storage, and is provided with a spigot 4 which is depressed when the cylinder is connected to the system at the consumer's premises and thereby opens the valve to allow gas to be withdrawn. A handle 5, shown separately in the drawing for clarity, surrounds the valve and in addition to providing a convenient means for handling the cylinder when it has to be transported, also acts as a guard to prevent damage to the valve by its being accidentally knocked.

Figure 2:
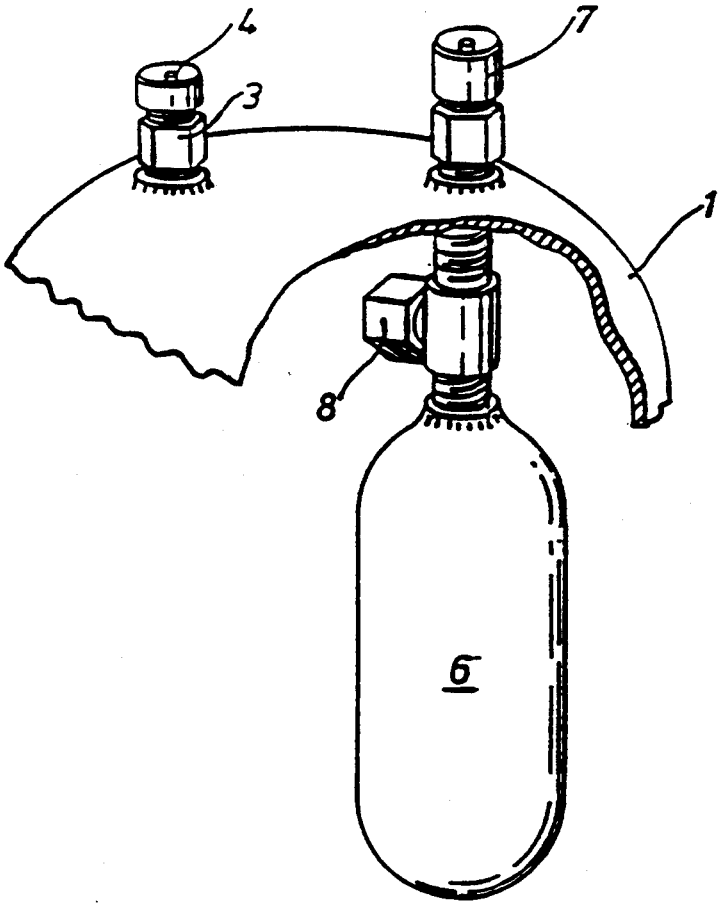
FIG. 2 is a fragmentary drawing showing a modification of the arrangement of FIG. 1.

In accordance with the embodiment of the present invention as shown in FIGS. 1 and 2, the main cylinder 1 is provided, during manufacture, with an internal reserve cylinder 6 communicating through the outer shell of a cylinder 1 with a second valve 7 of similar type to the valve 3.

In use, both of the cylinders are filled to capacity with liquified petroleum gas through their respective valves. Preferably the total overall capacity of the main cylinder is 12.7 Kg of liquified gas and between 4% and 55% of the gas is contained within the reserve cylinder. When the cylinder is installed at the customer's premises, connection is made to the valve 3. Use is then made, as required, of the gas until the liquid in the outer main cylinder 1 has been exhausted and the pressure begins to drop rapidly as the remaining gas is used up. The consumer then changes his connection from the valve 3 to the valve 7 and is then able to continue using the gas supply to complete whatever operations are in progress while an exchange cylinder is obtained from the supplier.

In the arrangement of FIG. 1 the gas supplier must make connection to both valve 3 and valve 7 in order to fill both the main and the reserve cylinders with the liquified gas. FIG. 2 is a fragmentary drawing showing an arrangement whereby the filling of the cylinders may be simplified. In this arrangement, the reserve cylinder 6 is provided with a non-return valve 8 which will allow gas to be admitted from the main to the reserve cylinder but hot vice versa. With this arrangement, both cylinders may be filled with liquified gas through the valve 3, the gas passing from the main cylinder 1 to the reserve cylinder 6 through the non-return valve 8.

Figure 3:
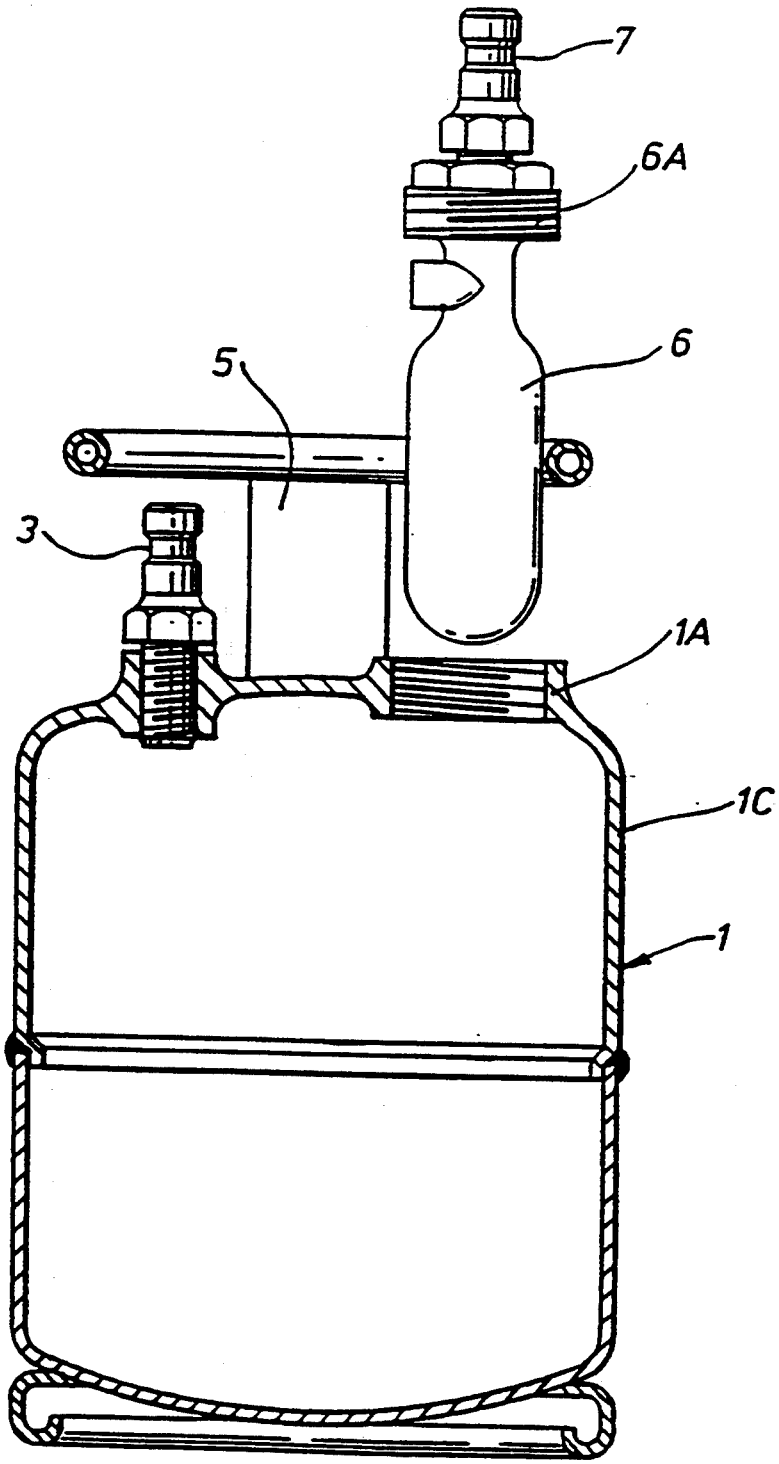
FIG. 3 is a sectional and part exploded view of another embodiment of the present invention.

Referring to FIG. 3, the reserve cylinder 6 is removable from and replaceable into the main cylinder 1 for servicing and replacement if necessary. Further, removal of the cylinder 6 permits a user or servicing company to service or replace the non-return valve 8.

Removability and replacement of the cylinder 6 is accomplished by forming an internally threaded boss 1A on the cylinder 1 and a correspondingly threaded head 6A on the cylinder 6. Further, to assist manufacture, the cylinder 1 is cast or otherwise formed in two parts 1C and 1D which are welded together as shown.

I claim:

1. A liquefied petroleum gas cylinder for domestic use, comprising a main cylinder provided with a rigid internal reserve cylinder disposed within the main cylinder, the main cylinder and the internal reserve cylinder each having a separate outlet valve for delivering gas to outside the main cylinder for connection to a consumer's system, wherein the internal reserve cylinder is removable from and replaceable into the main cylinder.

2. A liquified petroleum gas cylinder for domestic use according to claim 1 in which the reserve cylinder is provided with a non-return valve within the main cylinder body, whereby both cylinders may be charged through the main cylinder outlet valve.

3. A liquified petroleum gas cylinder for domestic use according to claim 1 or claim 2, in which the capacity of the reserve cylinder is from 4% to 55% of the combined capacity of the cylinders.

* * * * *